US010753377B2

(12) United States Patent
Kakio

(10) Patent No.: US 10,753,377 B2
(45) Date of Patent: Aug. 25, 2020

(54) CONTROL VALVE

(71) Applicant: SHIMADZU CORPORATION, Kyoto (JP)

(72) Inventor: Masafumi Kakio, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/611,849

(22) PCT Filed: Sep. 12, 2017

(86) PCT No.: PCT/JP2017/032879
§ 371 (c)(1),
(2) Date: Nov. 7, 2019

(87) PCT Pub. No.: WO2019/053783
PCT Pub. Date: Mar. 21, 2019

(65) Prior Publication Data

US 2020/0095104 A1 Mar. 26, 2020

(51) Int. Cl.
*F15B 13/04* (2006.01)
*F15B 13/01* (2006.01)
(Continued)

(52) U.S. Cl.
CPC ..... *F15B 13/0402* (2013.01); *F15B 11/003* (2013.01); *F15B 13/015* (2013.01); *F15B 13/024* (2013.01); *B66F 9/22* (2013.01)

(58) Field of Classification Search
CPC ..... F15B 11/003; F15B 13/01; F15B 13/015; F15B 13/024; F15B 13/0402; F15B 2211/55
See application file for complete search history.

(56) References Cited

U.S. PATENT DOCUMENTS 5,331,882 A * 7/1994 Miller ..... F15B 11/003 91/461
8,584,453 B2 * 11/2013 Skoog ..... F15B 11/003 251/33

(Continued)

FOREIGN PATENT DOCUMENTS

JP 2526813 2/1997
JP 2016217438 12/2016

OTHER PUBLICATIONS

"International Search Report (Form PCT/ISA/210) of PCT/JP2017/032879," dated Dec. 12, 2017, with English translation thereof, pp. 1-2.

(Continued)

*Primary Examiner* — Michael Leslie
(74) *Attorney, Agent, or Firm* — JCIPRNET

(57) ABSTRACT

A lock valve including a poppet valve element which is disposed within a spring chamber, a spring which biases the poppet valve element leftward, and a valve seat which comes into contact with the poppet valve element is disposed in a cavity formed in a valve body to mount a relief valve therein and is positioned further inward than the sleeve of the relief valve. The outer peripheral portion of the poppet valve element has hole portions formed therein at regular intervals. The outer peripheral portion of the valve seat, too, has hole portions formed therein at regular intervals. The valve portion of a solenoid valve is disposed between a passage which is in communication with the spring chamber and a passage which is in communication with a second flow passage open to a low-pressure region such as a hydraulic tank.

9 Claims, 7 Drawing Sheets

(51) Int. Cl.

| | |
|---|---|
| ***F15B 13/02*** | (2006.01) |
| ***F15B 11/00*** | (2006.01) |
| *B66F 9/22* | (2006.01) |

(56) References Cited

U.S. PATENT DOCUMENTS

| | | | | |
|---|---|---|---|---|
| 9,322,416 | B2 * | 4/2016 | Bissbort | F15B 11/003 |
| 2018/0112686 | A1 * | 4/2018 | Roberti | F15B 11/003 |

OTHER PUBLICATIONS

"Written Opinion of the International Searching Authority (Form PCT/ISA/237) of PCT/JP2017/032879," dated Dec. 12, 2017, with partial English translation thereof, pp. 1-4.

* cited by examiner

CONTROL VALVE

CROSS-REFERENCE TO RELATED APPLICATION

This application is a 371 application of the international PCT application serial no. PCT/JP2017/032879, filed on Sep. 12, 2017. The entirety of each of the above-mentioned patent application is hereby incorporated by reference herein and made a part of this specification.

BACKGROUND

Technical Field

The present invention relates to a control valve which is coupled to a hydraulic cylinder used in a forklift and the like.

Related Art

The control valve coupled to a hydraulic cylinder has a configuration in which a first flow passage to which high-pressure hydraulic oil is introduced and a second flow passage which is opened to a low-pressure region are selectively connected to a holding-side actuator port which biases a piston to a side where a conveyed object is held and a releasing-side actuator port which biases the piston to a side where the holding of the conveyed object is released (for example, see patent literature 1).

Furthermore, usually, between the holding-side actuator port and the second flow passage, or between the releasing-side actuator port and the second flow passage, a relief valve which maintains pressures of these regions equal to or below a fixed value is disposed.

LITERATURE OF RELATED ART

Patent Literature

Patent literature 1: Japanese Laid-Open Publication No. 2016-217438

SUMMARY

Problems to be Solved

In this control valve, like a roll clamp which is an attachment machine of a forklift, for a control valve coupled to a hydraulic cylinder for operating a holding mechanism which holds a conveyed object, it is necessary to incorporate a lock mechanism in a hydraulic circuit for the attachment machine in order to prevent the conveyed object from falling at the time of incorrect operation. Therefore, conventionally, in this hydraulic circuit, a lock valve which has a solenoid valve and a valve element such as a poppet or the like is disposed outside the control valve.

In view of this situation, in recent years, it is required to provide a control valve having the lock mechanism to simplify the device. However, in order to produce this control valve, it is necessary that after a valve seat is formed on a valve body, the valve element such as the poppet and a spring for biasing the valve element are disposed inside the valve body and a solenoid valve is attached to the valve body, and thus the entire control valve including the valve body is upsized. When the control valve is upsized in this way, a problem arises that it is hard to mount the control valve to the forklift or the like.

The present invention is completed to solve the above problem and aims to provide a control valve which can prevent a size of a device from increasing even when a lock mechanism is incorporated in the control valve.

Means to Solve Problems

According to one of the embodiments of the present invention a control valve is provided. The control valve couples to a hydraulic cylinder for operating a holding mechanism holding a conveyed object, and selectively connects a first flow passage and a second flow passage to a holding-side actuator port and a releasing-side actuator port. The first flow passage is introduced with high-pressure hydraulic oil, and the second flow passage is opened to a low-pressure region. The holding-side actuator port biases a piston to a side where the conveyed object is held, and the releasing-side actuator port biases the piston to a side where the holding of the conveyed object is released. In the control valve, a relief valve which maintains a pressure of the holding-side actuator port equal to or below a fixed value is disposed between the holding-side actuator port and the second flow passage. The control valve includes a lock valve mechanism having a lock valve and a solenoid valve for opening/closing the lock valve, the lock valve being configured by a valve element, a valve seat, and a spring which biases the valve element toward the valve seat. The lock valve opens/closes a passage between the holding-side actuator port and the second flow passage. A cavity for mounting the relief valve is configured in a valve body, and the lock valve is arranged at a position on a deep side of the relief valve in the cavity.

According to one of the embodiments of the present invention, the valve seat and the valve element are disposed in order at positions on a deep side of the relief valve in the cavity.

According to one of the embodiments of the present invention, the valve seat is configured at a front end of the relief valve on a side of the valve body, and the valve element is disposed at a position on a deep side of the relief valve in the cavity.

According to one of the embodiments of the present invention, the solenoid valve is disposed in a passage which communicates a spring chamber housing the spring with the second flow passage, and hole portions which communicate the holding-side actuator port with the spring chamber are configured in the valve element.

According to one of the embodiments of the present invention the solenoid valve and the relief valve are arranged adjacent to each other toward a same direction.

Effect

According to one of the embodiments of the present invention, because the lock valve is arranged at the position on a deep side of the relief valve in the cavity configured in the valve body for mounting the relief valve, the lock mechanism can be built in the control valve without enlarging the valve body.

According to one of the embodiments of the present invention, the hole portions configured in the valve element and the spring chamber can be used to open/close the passage between the holding-side actuator port and the second flow passage.

According to one of the embodiments of the present invention, the solenoid valve and the relief valve are arranged adjacent to each other toward the same direction, and thereby an occupancy space of the device can be further reduced.

BRIEF DESCRIPTION OF THE DRAWINGS

FIG. 2 is a cross-section view showing the control valve according to the present invention along with a hydraulic cylinder 10 and the like.

FIG. 3 is an enlarged cross-section view showing a lock valve 50 along with a relief valve 41 and the like.

FIG. 7 is an enlarged cross-section view showing a lock valve 50 according to a second embodiment of the present invention along with a relief valve 41 and the like.

DESCRIPTION OF THE EMBODIMENTS

Figure 1:
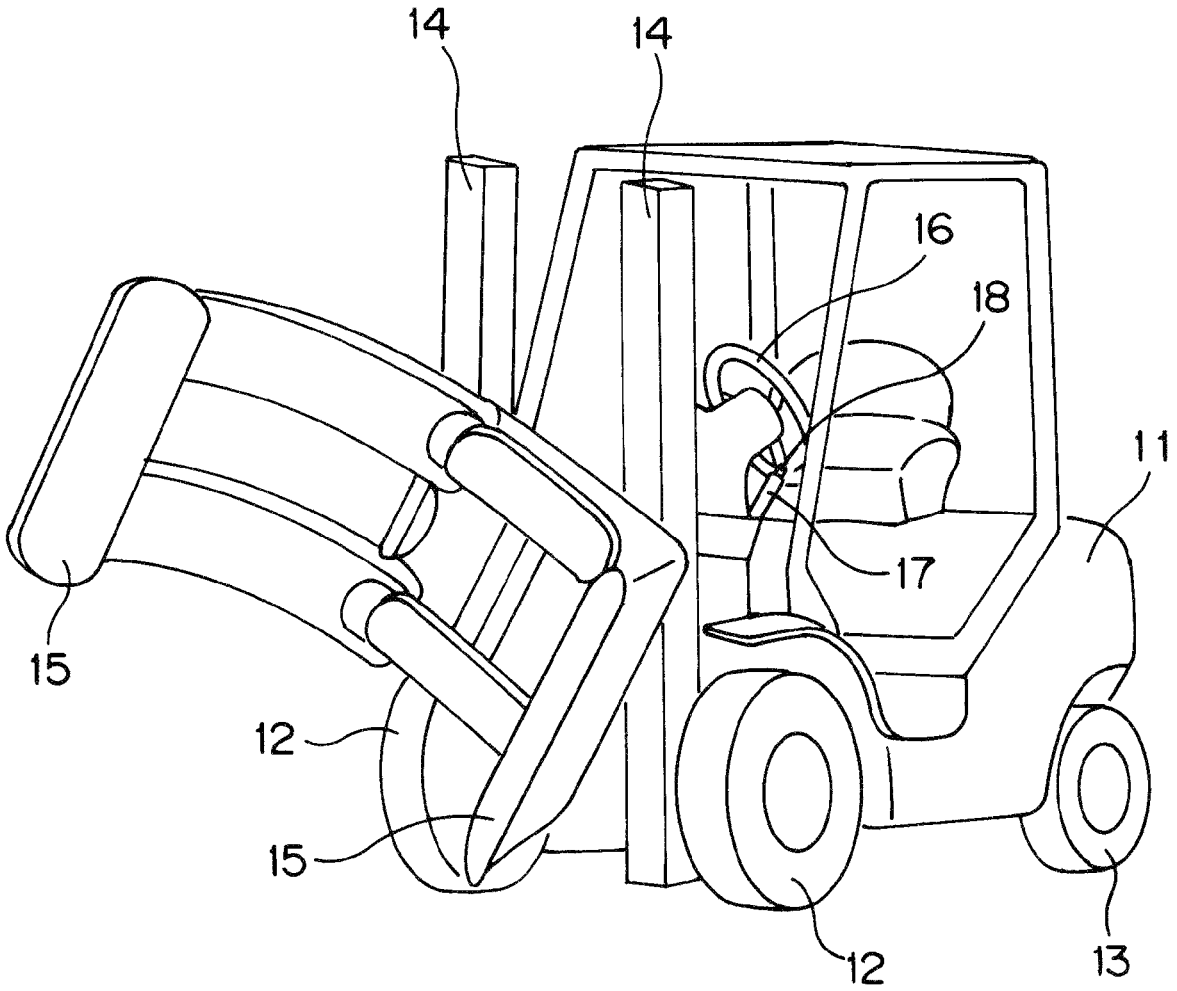
FIG. 1 is a schematic view of a forklift to which a control valve according to the present invention is applied.

Embodiments of the present invention are describe below based on the drawings. First, a configuration of a forklift to which a control valve according to the present invention is applied is described. FIG. 1 is a schematic view of the forklift to which the control valve according to the present invention is applied.

The forklift includes a full rotation roll clamp mechanism for conveying roll paper or the like as an attachment machine and includes a main body 11 including front wheels 12 which are traveling wheels and rear wheels 13 which are steering wheels, a steering 16 for operating the rear wheels 13 which are steering wheels, a pair of masts 14, a pair of roll clamps 15 which is raised/lowered with respect to the pair of masts 14, a lever 17 for opening/closing the pair of roll clamps 15, and a lock releasing button 18 which is disposed on a front end of the lever 17. Furthermore, in FIG. 1, illustration of a lever or the like for performing other operations including the raising/lowering operation of the roll clamps 15 is omitted.

Figure 2:
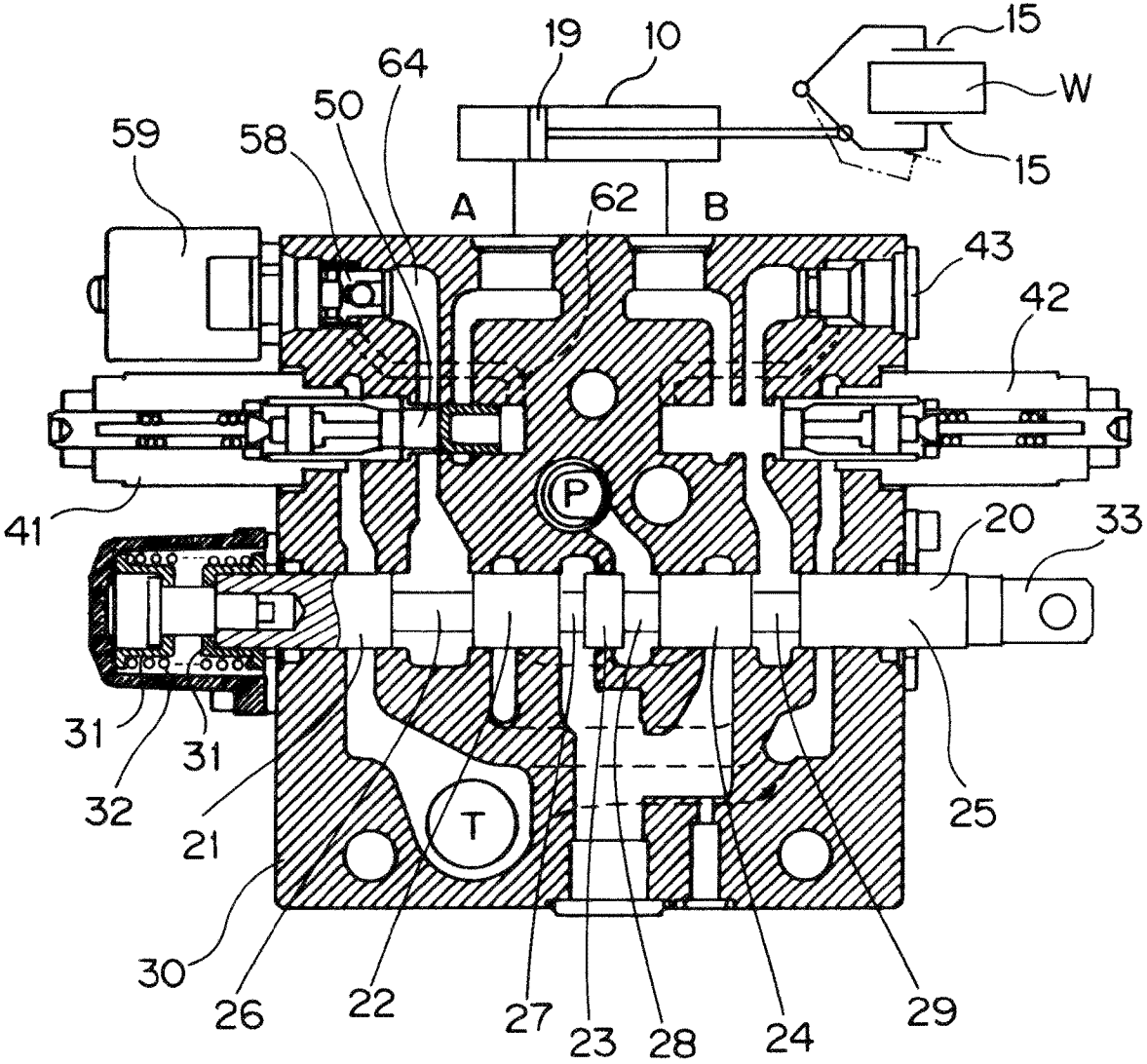

FIG. 2 is a cross-section view showing the control valve according to the present invention along with a hydraulic cylinder 10 and the like. Furthermore, in this diagram, a state in which a main spool 20 is arranged in a neutral position is shown.

The control valve is coupled to the hydraulic cylinder 10 for operating the roll clamps 15 serving as a holding mechanism that holds a work piece (a conveyed object) W such as roll paper or the like. The control valve selectively connects a first flow passage P to which high-pressure hydraulic oil is introduced from a hydraulic pump and a second flow passage T which is opened to a low-pressure region such as a hydraulic tank or the like to a holding-side actuator port A for biasing a piston 19 of the hydraulic cylinder 10 to a side where the work piece W is held by the pair of roll clamps 15 and a releasing-side actuator port B for biasing the piston 19 to a side where the holding of the work piece W by the pair of roll clamps 15 is released.

The control valve includes the main spool 20 in which a plurality of land portions 21, 22, 23, 24, 25 and a plurality of groove portions 26, 27, 28, 29 are alternately formed and which is reciprocally movable in a left-right direction shown in FIG. 2 with respect to a valve body 30. An end portion 33 on the right of the main spool 20 is connected to the lever 17 shown in FIG. 1. In addition, a pair of spring retainers 31 and a return spring 32 are disposed on an end portion on the left of the main spool 20.

In addition, in the control valve, a relief valve 41 for maintaining a pressure of the holding-side actuator port A equal to or below a fixed value is disposed between the holding-side actuator port A and the second flow passage T, and a relief valve 42 for maintaining a pressure of the releasing-side actuator port B equal to or below a fixed value is disposed between the releasing-side actuator port B and the second flow passage T. Furthermore, a symbol 43 shown in FIG. 2 represents a lid for closing unused cavities (recesses).

Furthermore, the control valve includes a lock valve 50 which is disposed at a position on a deep side of the relief valve 41 in a cavity formed in the valve body 30 in order to mount the relief valve 41, and a solenoid valve 59 having a valve portion 58 for opening/closing the lock valve 50. The lock valve 50 has a function of opening/closing a passage between the holding-side actuator port A and the second flow passage T. In addition, the solenoid valve 59 is operated by pressing the lock releasing button 18 shown in FIG. 1. Besides, the solenoid valve 59 connects/disconnects a passage 62 which is in communication with a spring chamber 61 described later with a passage 64 which is in communication with the second flow passage T opened to a low-pressure region such as the hydraulic tank.

Figure 3:
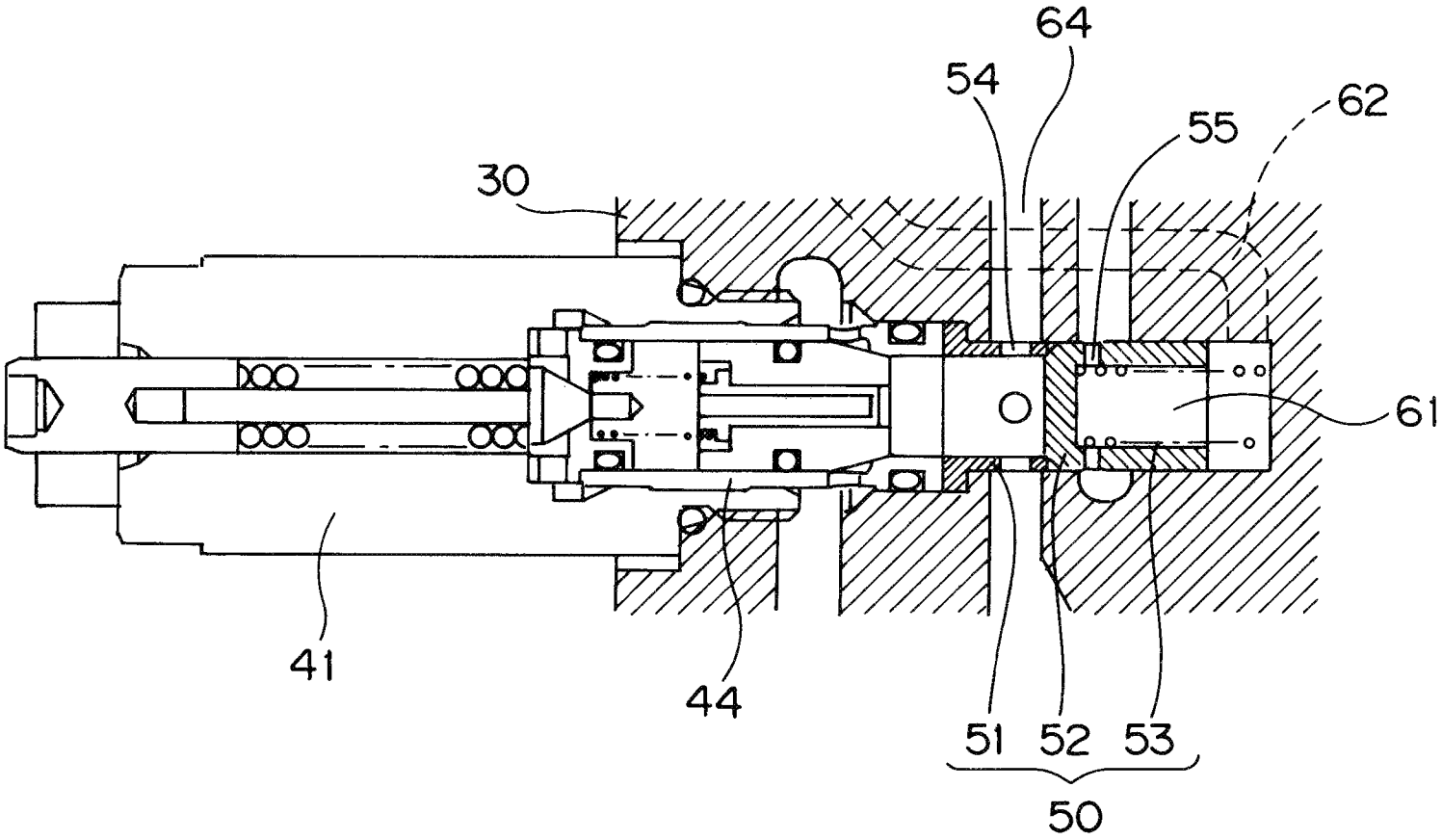

FIG. 3 is an enlarged cross-section view showing the lock valve 50 along with the relief valve 41 and the like.

As shown in FIG. 3, at the position on a deep side of a sleeve 44 of the relief valve 41 in the cavity formed in the valve body 30 in order to mount the relief valve 41, the lock valve 50 is disposed which includes a poppet valve element 52 disposed inside the spring chamber 61, a spring 53 biasing the poppet valve element 52 to the left-side direction shown in FIG. 3, and a valve seat 51 which comes into contact with the poppet valve element 52. An outer peripheral portion of the poppet valve element 52 has hole portions 55 formed therein at a fixed interval. In addition, an outer peripheral portion of the valve seat 51 also has hole portions 54 formed therein at a fixed interval. Besides, as shown in FIG. 2 and FIG. 3, the valve portion 58 in the above-described solenoid valve 59 is disposed between the passage 62 which is in communication with the spring chamber 61 and the passage 64 which is in communication with the second flow passage T opened to a low-pressure region such as the hydraulic tank.

Figure 4:
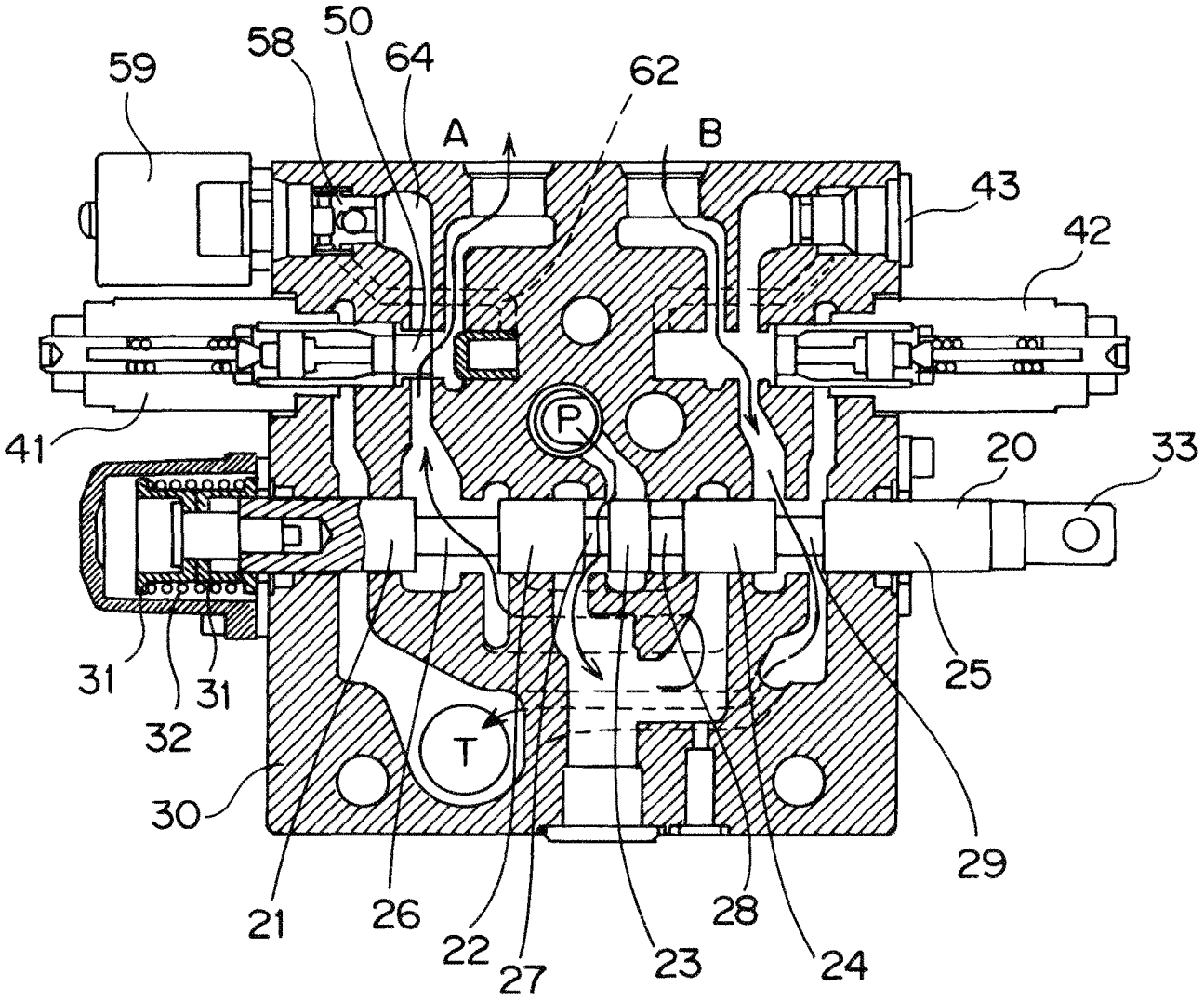
FIG. 4 is a longitudinal cross-section view of the control valve for illustrating an operation of the control valve.
Figure 5:
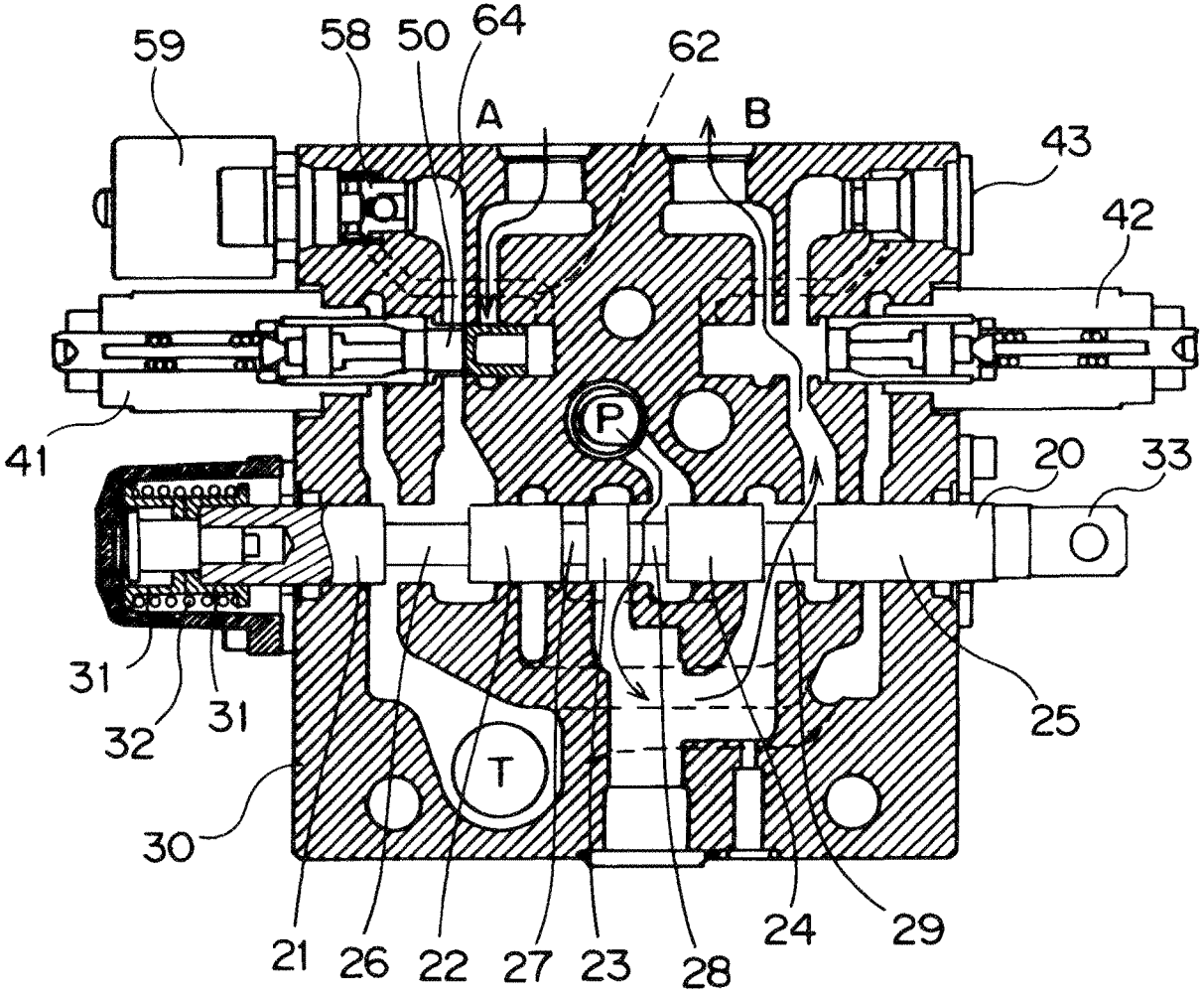
FIG. 5 is a longitudinal cross-section view of the control valve for illustrating an operation of the control valve.
Figure 6:
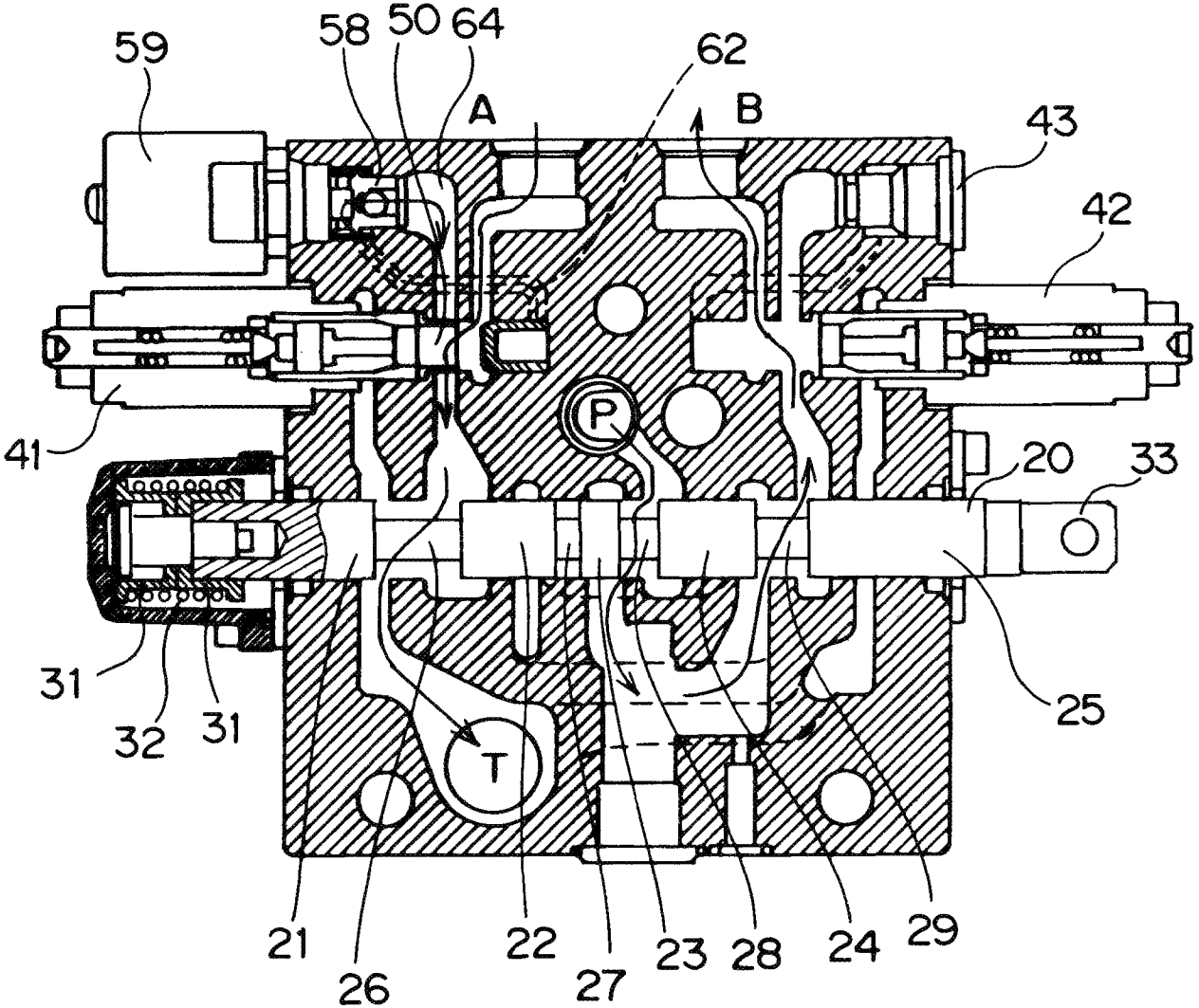
FIG. 6 is a longitudinal cross-section view of the control valve for illustrating an operation of the control valve.

Next, operations of the control valve according to the present invention are described. FIGS. 4-6 are longitudinal cross-section views of the control valve for illustrating operations of the control valve according to the present invention. Furthermore, FIG. 4 shows a state in which the main spool 20 is arranged in a position on the right side, FIG. 5 shows a state in which the main spool 20 is arranged in a position on the left side and the lock valve 50 is closed, and FIG. 6 shows a state in which the main spool 20 is arranged in a position on the left side and the lock valve 50 is opened.

As shown in FIG. 2, in the state that the main spool 20 is arranged in the neutral position, the holding-side actuator port A for biasing the piston 19 of the hydraulic cylinder 10 to the side where the work piece W is held by the pair of roll clamps 15 and the releasing-side actuator port B for biasing the piston 19 to the side where the holding of the work piece W by the pair of roll clamps 15 is released are blocked, by the action of the plurality of land portions 21, 22, 23, 24, 25 in the main spool 20, from the first flow passage P to which the high-pressure hydraulic oil is introduced from the hydraulic pump and the second flow passage T opened to the low-pressure region such as the hydraulic tank or the like. Therefore, pumping of the hydraulic oil to the hydraulic cylinder 10 is not performed.

When an operator operates the lever 17 shown in FIG. 1, and thereby the main spool 20 coupled to the lever 17 is moved, as shown in FIG. 4, to the right side from this state, by the action of the groove portion 26 and the groove portion 27, a passage of the hydraulic oil from the first flow passage P to which the high-pressure hydraulic oil is introduced to the holding-side actuator port A is formed. In addition, by the action of the groove portion 29, a passage of the hydraulic oil from the releasing-side actuator port B to the second flow passage T opened to a low-pressure region such as the hydraulic tank or the like is formed. In this way, the hydraulic oil flows as shown by an arrow in FIG. 4, the piston 19 of the hydraulic cylinder 10 is moved to the right side shown in FIG. 2, and the work piece W is held by the pair of roll clamps 15.

On the other hand, when the operator operates the lever 17 shown in FIG. 1, and thereby the main spool 20 coupled to the lever 17 is moved, as shown in FIG. 5, to the left side from the state shown in FIG. 2, by the action of the groove portion 28 and the groove portion 29, a passage of the hydraulic oil from the first flow passage P to which the high-pressure hydraulic oil is introduced to the releasing-side actuator port B is formed. In addition, by the action of the groove portion 26, a passage of the hydraulic oil from the holding-side actuator port A to the second flow passage T opened to a low-pressure region such as the hydraulic tank or the like is formed. At this time, the passage of the hydraulic oil from the first flow passage P to the holding-side actuator port A is closed by the action of the land portion 22. In addition, the passage of the hydraulic oil from the releasing-side actuator port B to the second flow passage T is closed by the action of the land portion 25.

Thereby, in this state, the passage of the hydraulic oil from the holding-side actuator port A to the second flow passage T opened to a low-pressure region such as the hydraulic tank is formed, and in a state that the operator does not press the lock releasing button 18 disposed on the front end of the lever 17 in FIG. 1, by the action of the solenoid valve 59, the passage 62 in communication with the spring chamber 61 is closed, by the valve portion 58 of the solenoid valve 59, from the passage 64 in communication with the second flow passage T opened to a low-pressure region such as the hydraulic tank or the like. In this state, by the action of the hole portions 55 formed in the poppet valve element 52, the hydraulic oil within the spring chamber 61 has a high pressure. Therefore, as shown in FIG. 3, a state in which the poppet valve element 52 comes into contact with the valve seat 51 is maintained, and the holding-side actuator port A and the second flow passage T opened to a low-pressure region such as the hydraulic tank or the like are blocked. Therefore, the holding state of the work piece W by the roll clamps 15 is not released.

When the operator presses the lock releasing button 18 disposed on the front end of the lever 17 shown in FIG. 1 from the state shown in FIG. 5, by the action of the solenoid valve 59, the passage 62 in communication with the spring chamber 61 is communicated with the passage 64 in communication with the second flow passage T opened to a low-pressure region such as the hydraulic tank or the like. In this way, the pressure of the hydraulic oil in the spring chamber 61 is reduced, and the hydraulic oil flows into the spring chamber 61 from the holding-side actuator port A. Therefore, as shown in FIG. 6, the poppet valve element 52 is separated from the valve seat 51, and the blocked state of the passage of the hydraulic oil from the holding-side actuator port A to the second flow passage T opened to a low-pressure region such as the hydraulic tank or the like is released. Accordingly, the hydraulic oil flows as shown by an arrow in FIG. 6. Therefore, the piston 19 of the hydraulic cylinder 10 is moved to the left side shown in FIG. 2, the holding state of the work piece W by the pair of roll clamps 15 is released, and the work piece W is released.

As described above, in the control valve according to the present invention, the lock mechanism can be achieved in which the holding of the work piece W is released only when the operator presses the lock releasing button 18 and the lever 17 is operated to the side where the holding of the work piece W by the pair of roll clamps 15 is released. At this time, because the lock valve 50 is disposed at the position on a deep side of the relief valve 41 in the cavity formed in the valve body 30 in order to mount the relief valve 41, the cavity can be shared, and the valve body 30 is not upsized. Besides, by arranging the solenoid valve 59 and the relief valve 41 adjacent to each other toward the same direction, an occupancy space of the device can be further reduced.

Figure 7:
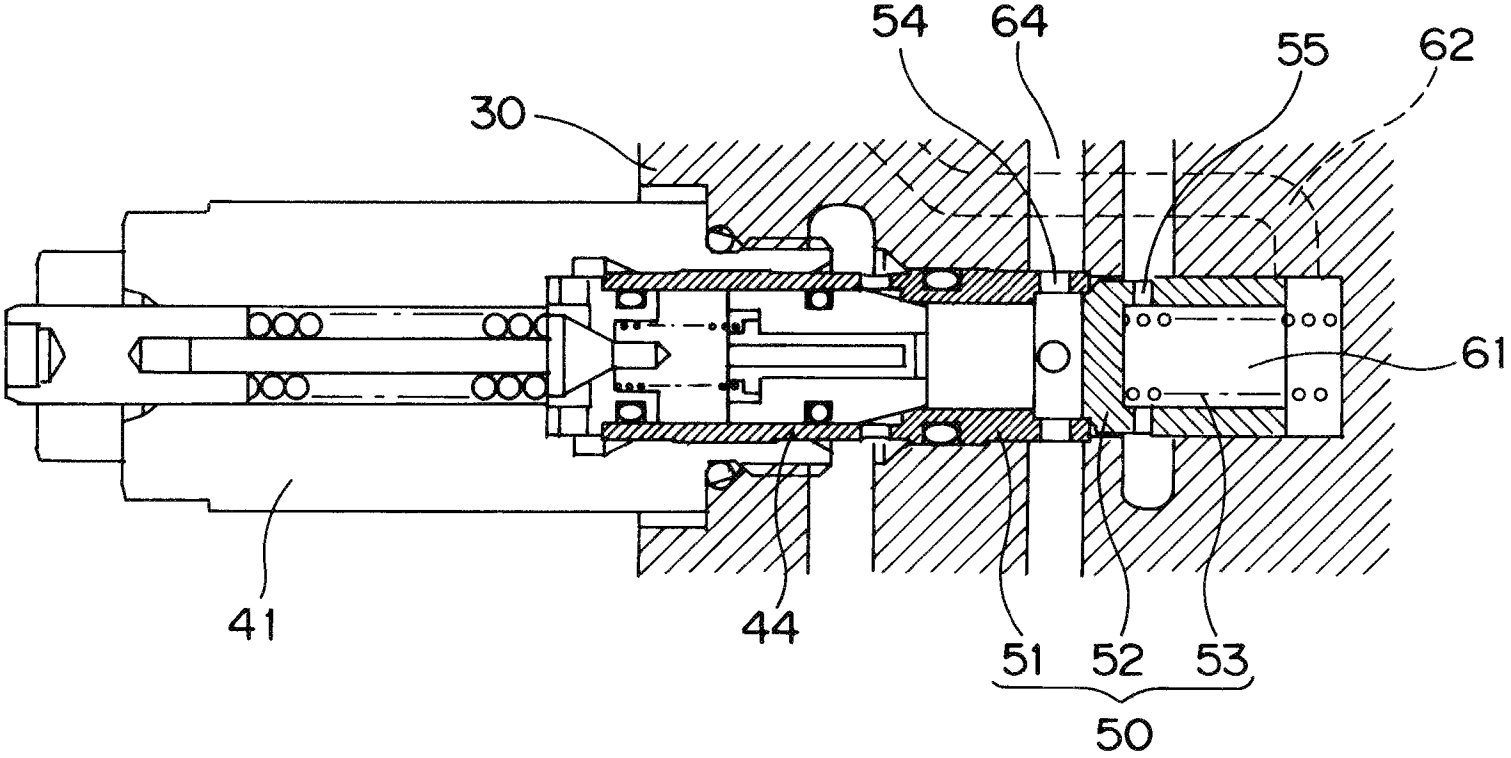

Next, another embodiment of the present invention is described. FIG. 7 is an enlarged cross-section view showing a lock valve 50 according to a second embodiment of the present invention along with a relief valve 41 and the like. Furthermore, members the same as those in the above-described first embodiment are denoted by the same symbols and specific description is omitted.

The lock valve 50 according to the above-described first embodiment has a configuration in which the valve seat 51 and the poppet valve element 52 are disposed in order at the positions on a deep side of the relief valve 41 in the cavity formed in the valve body 30 in order to mount the relief valve 41. In contrast, the lock valve 50 according to the second embodiment has a configuration in which the valve seat 51 is formed in a front end of the sleeve 44 in the relief valve 41, and the poppet valve element 52 is disposed at a position on a deep side of the valve seat 51 formed in the sleeve 44 of the relief valve 41 in a cavity formed in the valve body 30 in order to mount the relief valve 41.

In the control valve according to the second embodiment, similar to the control valve according to the first embodiment, the valve body 30 can also be prevented from upsizing and an occupancy space of the device is reduced while the lock function is achieved.

In addition, in the above-described first embodiment, a mass-produced product can be used as the relief valve 41, but the size of the poppet valve element 52 is limited. In contrast, in the second embodiment, it is necessary to form the valve seat 51 in the sleeve 44 in the relief valve 41, and thus a relief valve which is a mass-produced product cannot be used. However, in the second embodiment, by a design form of the valve seat formed on the front end of the sleeve 44, the poppet valve element 52 can be upsized. Accordingly, the control valve which enlarges the oil passage at the time of releasing the lock valve 50 and reduces pressure loss can be made.

Furthermore, in the above-described embodiments, a case in which the control valve according to the present invention is applied to the forklift including the roll clamp mechanism is described; however, the control valve according to the present invention may also be applied to other machines in which a lock valve mechanism is required.

What is claimed is:

1. A control valve, which couples to a hydraulic cylinder for operating a holding mechanism holding a conveyed object, and selectively connects a first flow passage and a second flow passage to a holding-side actuator port and a releasing-side actuator port, wherein the first flow passage is introduced with high-pressure hydraulic oil, and the second flow passage is opened to a low-pressure region, and the holding-side actuator port biases a piston to a side where the conveyed object is held, and the releasing-side actuator port biases the piston to a side where a holding of the conveyed object is released, the control valve comprises:

a relief valve which is disposed between the holding-side actuator port and the second flow passage and maintains a pressure of the holding-side actuator port equal to or below a fixed value; and a lock valve mechanism comprising a lock valve and a solenoid valve for opening/closing the lock valve, wherein the lock valve is configured by a valve element, a valve seat, and a spring which biases the valve element toward the valve seat, and the lock valve opens/closes a passage between the holding-side actuator port and the second flow passage;

wherein a cavity for mounting the relief valve is configured in a valve body, and the lock valve is arranged at a position on a deep side of the relief valve in the cavity.

2. The control valve according to claim 1, wherein the valve seat and the valve element are disposed in order at positions on a deep side of the relief valve in the cavity.

3. The control valve according to claim 1, wherein the valve seat is configured at a front end of the relief valve on a side of the valve body, and the valve element is disposed at a position on a deep side of the relief valve in the cavity.

4. The control valve according to claim 1, wherein the solenoid valve is disposed in a passage which communicates a spring chamber housing the spring with the second flow passage, and hole portions which communicate the holding-side actuator port with the spring chamber are configured in the valve element.

5. The control valve according to claim 1, wherein the solenoid valve and the relief valve are arranged adjacent to each other toward a same direction.

6. The control valve according to claim 2, wherein the solenoid valve is disposed in a passage which communicates a spring chamber housing the spring with the second flow passage, and hole portions which communicate the holding-side actuator port with the spring chamber are configured in the valve element.

7. The control valve according to claim 3, wherein the solenoid valve is disposed in a passage which communicates a spring chamber housing the spring with the second flow passage, and hole portions which communicate the holding-side actuator port with the spring chamber are configured in the valve element.

8. The control valve according to claim 2, wherein the solenoid valve and the relief valve are manged adjacent to each other toward a same direction.

9. The control valve according to claim 3, wherein the solenoid valve and the relief valve are arranged adjacent to each other toward a same direction.

* * * * *